US007637390B2

(12) United States Patent
Bocola

(10) Patent No.: US 7,637,390 B2
(45) Date of Patent: Dec. 29, 2009

(54) JAR FOR COSMETIC AND PHARMACEUTICAL CREAMS

(76) Inventor: Giovanni Bocola, Via G. Rossa, 2, I-20037 Paderno Dugnano, Milano (IT)

( * ) Notice: Subject to any disclaimer, the term of this patent is extended or adjusted under 35 U.S.C. 154(b) by 489 days.

(21) Appl. No.: 10/500,754

(22) PCT Filed: Feb. 11, 2002

(86) PCT No.: PCT/IT02/00081

§ 371 (c)(1),
(2), (4) Date: Mar. 17, 2005

(87) PCT Pub. No.: WO03/055348

PCT Pub. Date: Jul. 10, 2003

(65) Prior Publication Data

US 2005/0167388 A1 Aug. 4, 2005

(30) Foreign Application Priority Data

Jan. 4, 2002 (IT) ..... MI2002A0003

(51) Int. Cl.
*B65D 43/16* (2006.01)

(52) U.S. Cl. ..... 220/849; 220/839; 220/4.23

(58) Field of Classification Search ..... 220/4.23, 220/375, 839, 849, 628, 635, 62.18; 215/306; 206/235, 581; 132/293
See application file for complete search history.

(56) References Cited

U.S. PATENT DOCUMENTS

| | | | | |
|---|---|---|---|---|
| 1,852,455 | A * | 4/1932 | Friedman | 132/293 |
| 2,734,651 | A * | 2/1956 | Lindstrom | 215/329 |
| 3,331,523 | A * | 7/1967 | Exton | 215/350 |
| 3,973,690 | A * | 8/1976 | Schneider | 215/329 |
| 4,744,481 | A * | 5/1988 | Morgan, Jr. | 215/329 |
| 5,209,184 | A * | 5/1993 | Sharkan et al. | 119/61.56 |
| 7,198,161 | B2 * | 4/2007 | Bucholtz | 215/237 |

FOREIGN PATENT DOCUMENTS

WO WO 0172167 A1 * 10/2001

* cited by examiner

*Primary Examiner*—Anthony D Stashick
*Assistant Examiner*—James N Smalley
(74) *Attorney, Agent, or Firm*—James V. Costigan; Hedman & Costigan, P.C.

(57) ABSTRACT

The present invention relates to a jar (1) for cosmetic and pharmaceutical creams, which comprises a holding body (2), defining, in a single piece, an inner vessel (3) and an outer mantle (4) extending from the mouth (5) of the inner vessel (3) and ending under the bottom (3*a*) of the inner vessel (3) to provide a gap (6) encompassing the outside of the inner vessel. Advantageously a closure cover (10) to be applied for closing said mouth (5) is moreover provided.

2 Claims, 3 Drawing Sheets

JAR FOR COSMETIC AND PHARMACEUTICAL CREAMS

BACKGROUND OF THE INVENTION

The present invention relates to a jar which has been specifically designed for cosmetic and pharmaceutical creams.

As is known, in the cosmetic and pharmaceutical field are at present broadly used containers or jars which, in addition to properly folding therein the cosmetic or pharmaceutical cream or the like, must also properly protect the product.

In particular, are at present commercially available cosmetic products, such as creams and the like, which must be tightly protected against the light and heat, in order to prevent the product from being spoiled.

In order to solve the above mentioned problems, prior jars for the above mentioned use conventionally comprise an outer body, having an inner cavity, in which is arranged an inner vessel.

The latter is made separately from the outer vessel, thereby defining a gap encompassing the inner vessel which operates as a protective element.

Such an arrangement is, however, very expensive, since it provides to use two different separated vessels.

Moreover, the handling of the inner vessel, during the filling-in of the product, is very critical.

Another problem affecting prior containers or jars, is that they require an undercover closure, which, practically, consists of a washer element.

The latter operates to close the inner vessel and must be separately removed from the cover, thereby two different operations are required.

Furthermore, the above mentioned washer element hinders a proper packaging and use of the product.

SUMMARY OF THE INVENTION

Accordingly, the aim of the present invention is to overcome the above mentioned drawbacks, by providing a jar, specifically designed for cosmetic and pharmaceutical creams, having a greatly simplified construction, without negatively affecting its technical and functional characteristics.

Within the scope of the above mentioned aim, a main object of the present invention is to provide such a jar, in which the removal and handling of the undercover washer element is very simple, thereby facilitating any related operations.

Another object of the present invention is to provide such a jar, specifically designed for cosmetic and pharmaceutical creams, which, owing to its specifically designed constructional characteristics, is very reliable and safe in operation.

Yet another object of the present invention is to provide such a jar which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a jar specifically designed for cosmetic and pharmaceutical creams, characterized in that said jar comprises a holding body, defining, in a single piece, an inner vessel and an outer mantle, said outer mantle extending from the mouth of the inner vessel and ending under the bottom of the inner vessel to provide a gap encompassing the outside of said inner vessel, a closure cover to be applied for closing said mouth being moreover provided.

BRIEF DESCRIPTION OF THE DRAWINGS

Further characteristics, and advantages of the present invention will become more apparent hereinafter from the following detailed disclosure of a preferred, though not exclusive, embodiment of a jar specifically designed for cosmetic and pharmaceutical creams, which is illustrated, by way of an indicative, but not limitative, example, in the figures of the accompanying drawings, where.

DESCRIPTION OF THE PREFERRED EMBODIMENT

Figure 1:
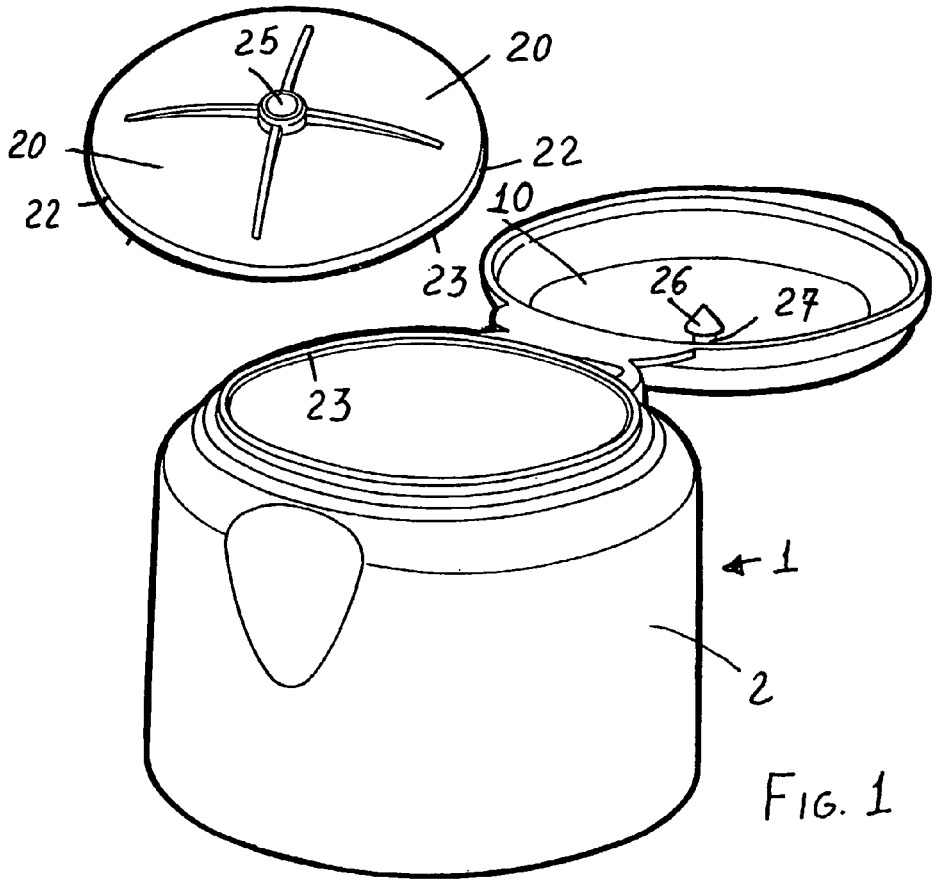
FIG. 1 is a perspective exploded view illustrating the jar according to the invention in an opened position thereof.
Figure 2:
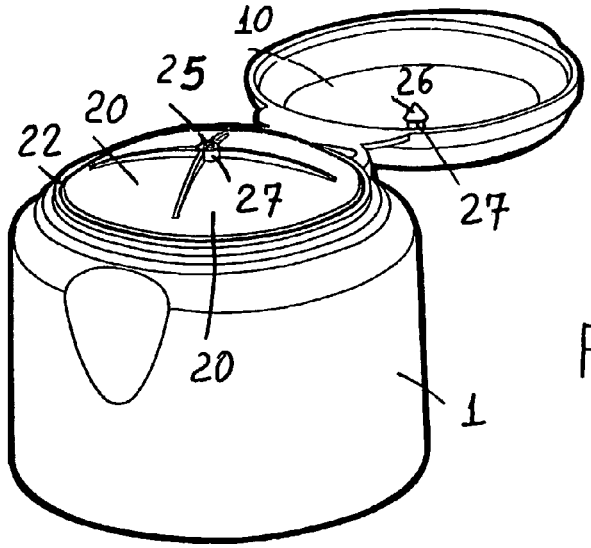
FIG. 2 is a further perspective view illustrating the jar with its cover being opened, and its washer element so arranged as to close the mouth of said jar.
Figure 3:
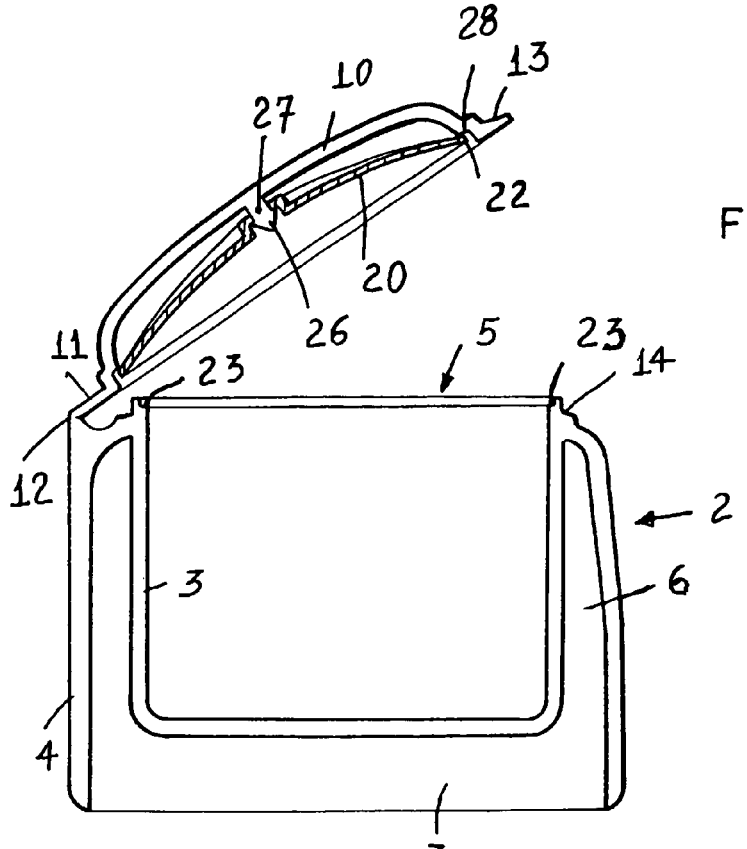
FIG. 3 is a side cross-sectional view showing the jar, in an opened position thereof.
Figure 4:
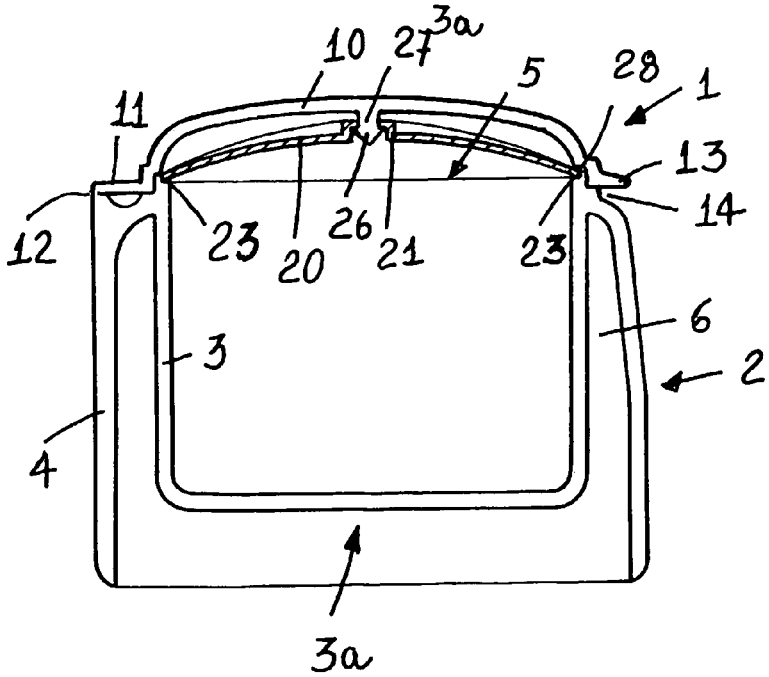
FIG. 4 is a schematic cross-sectional view illustrating the jar in a closed position thereof.
Figure 5:
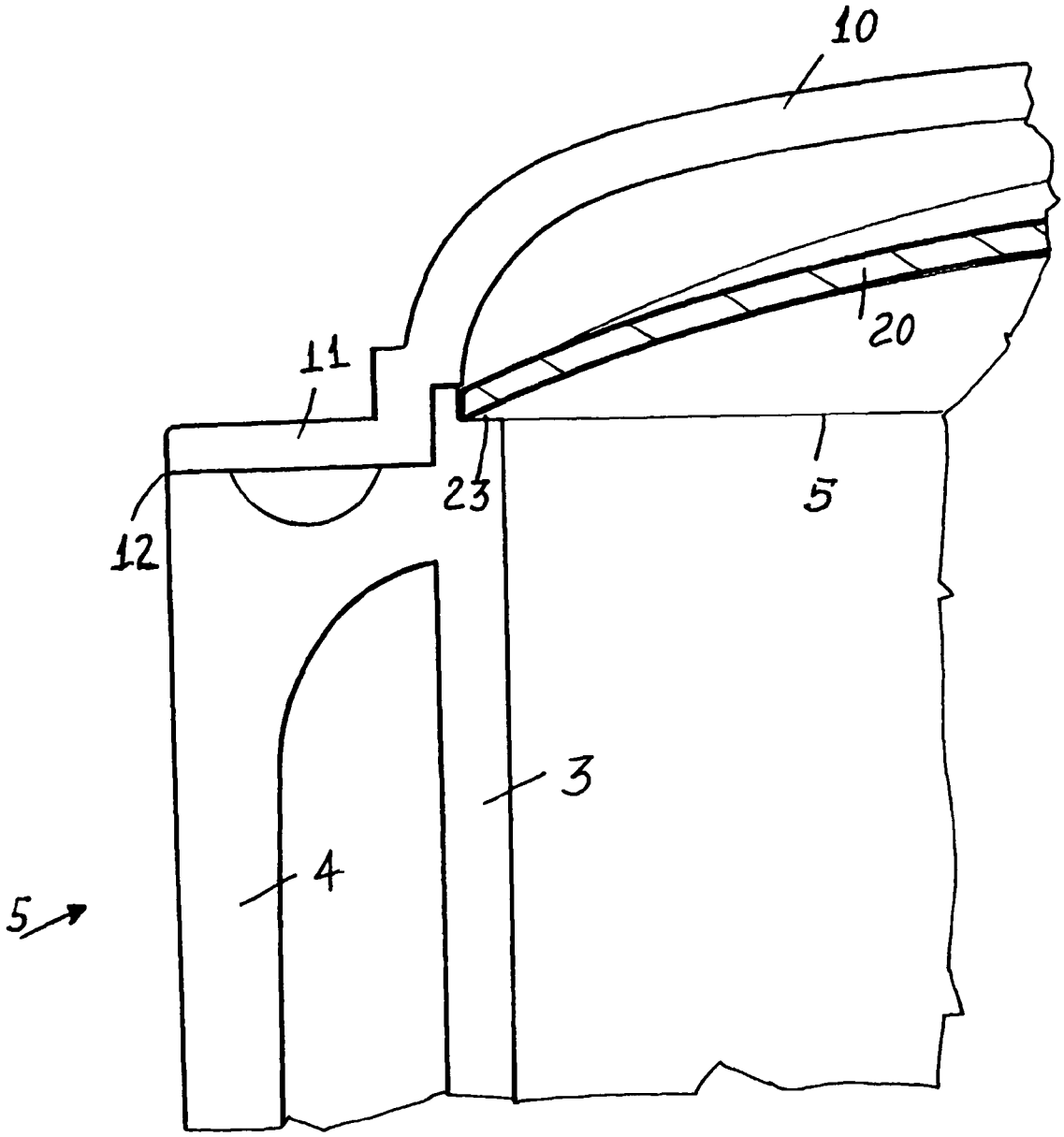
FIG. 5 is a partial side view of the jar according to the present invention.

With reference to the number references of the above mentioned figures, the jar specifically designed for cosmetic and pharmaceutical creams, according to the invention, which is generally indicated by the reference number 1, comprises a holding body 2, defining, in a single piece, an inner vessel 3 and an outer mantle 4, extending from the mouth 5 of the inner vessel and ending under the bottom 3*a* of said inner vessel, thereby providing a gap 6 encompassing the outside of the inner vessel.

This embodiment provides the subject jar with a very high mechanical strength, together with the possibility of forming a gap, which, in turn, provides a very good protection both for heat and light.

The mouth 5 is closed by a cover 10 which is advantageously made in a single body with the jar and comprises a lug 11, with a weakened line 12, for connecting it to the top edge of the outer mantle 4.

Arranged diametrically on the cover 10 is provided a gripping tongue 13 which, with the cover in a closed condition, is advantageously arranged near a cut-out 14 formed on the top portion of the mantle 4.

Another very important feature of the invention is that an undercover washer element 20 is provided, said undercover washer element having a central body 21 connected with a perimetrical lip 22 operating as a gasket and housed in an undercut step 23, formed at the top portion of the mouth 5 of the holding body 2.

The undercover 20 is provided with an axially extending opening 25, in which can be engaged the enlarged head 26 of a peg 27, which is made as a single body with the cover.

The above disclosed arrangement allows the undercover 20 to be easily applied to tightly close the mouth 5, and this also owing to the fact that it is arranged under an abutment edge or rim 28, formed on the inner surface of the cover 10.

As the cover 10 is opened, also the undercover 20 is opened, thereby fully opening, by a single operation, the jar.

Moreover, this arrangement provides the great advantage that no undercover washer must be positioned, which would risk to soil the jar surfaces.

From the above disclosure, it should be apparent that the invention fully achieves the intended aim and objects.

In particular, the invention provides a jar, specifically designed for cosmetic and pharmaceutical creams, which can be advantageously made of polypropylene or other plastics materials suitable for the product packaged in said jar.

The jar, moreover, provides a suitable protection for the product held therein, while having a very simple construction.

Another important feature of the invention, moreover, is that the jar is made as a single piece.

Furthermore, the undercover element is interconnected to the cover, thereby it can be opened and closed without the need of directly handling it, but by simply exploiting the opening and closing movements of the cover.

The invention, as disclosed, is susceptible to several modifications and variations, all of which will come within the scope of the invention.

Moreover, all of the constructional details can be replaced by other technically equivalent elements.

In practicing the invention, the used materials, as well as the contingent size and shapes, can be any, depending on requirements.

The invention claimed is:

1. A jar for cosmetic and pharmaceutical creams, comprising a holding body, defining, in a single piece, an inner vessel having an inner vessel mouth and inner vessel bottom, said inner vessel being encompassed by a thermally light insulating gap defined by an outer mantle extending from said mouth of said inner vessel and ending under said bottom of said inner vessel, and a closure cover for swingably closing said mouth, said closure cover being made in a single piece with said holding body, wherein said closure cover comprises a coupling lug with a weakened line for pivotably coupling said closure cover to said holding body, said closure cover further including a cover gripping tongue, and wherein said outer mantle has a top edge including, diametrically of said lug, a cut-out for facilitating an access to said cover gripping tongue, wherein said jar comprises an undercover washer element to be operatively coupled to said closure cover for tightly closing said mouth of said inner vessel, as said closure cover is swingably closed, wherein said undercover washer element comprises a convex central portion ending in a perimetrical lip operating as a gasket and housed in an undercut step formed at a top portion of said mouth, and wherein said undercover washer element comprises a throughgoing hole to be engaged by an enlarged head of a peg formed in a single piece with said cover.

2. A jar for cosmetic and pharmaceutical creams, comprising a holding body, defining, in a single piece, an inner vessel having an inner vessel mouth and inner vessel bottom, said inner vessel being encompassed by a thermally light insulating gap defined by an outer mantle extending from said mouth of said inner vessel and ending under said bottom of said inner vessel, and a closure cover for swingably closing said mouth, said closure cover being made in a single piece with said holding body, wherein said closure cover comprises a coupling lug with a weakened line for pivotably coupling said closure cover to said holding body, said closure cover further including a cover gripping tongue, and wherein said outer mantle has a top edge including, diametrically of said lug, a cut-out for facilitating an access to said cover gripping tongue, wherein said jar comprises an undercover washer element to be operatively coupled to said closure cover for tightly closing said mouth of said inner vessel, as said closure cover is swingably closed, wherein said undercover washer element comprises a convex central portion ending in a perimetrical lip operating as a gasket and housed in an undercut step formed at a top portion of said mouth, and wherein said undercover washer element comprises a throughgoing hole to be engaged by an enlarged head of a peg formed in a single piece with said cover, and wherein said convex central portion of said washer element defines with an under surface of said cover a further gap also providing heat and light protecting properties.

* * * * *